United States Patent [19]

Loth et al.

[11] Patent Number: 4,974,218

[45] Date of Patent: Nov. 27, 1990

[54] WATCH CASE INCLUDING A SINTERED CASEBAND

[75] Inventors: Eric Loth; Gaston Gagnebin, both of Bienne, Sweden

[73] Assignee: Tissot S.A., Le Locle, Switzerland

[21] Appl. No.: 439,602

[22] Filed: Nov. 21, 1989

[30] Foreign Application Priority Data

Nov. 23, 1988 [CH] Switzerland ..... 04337/88

[51] Int. Cl.[5] ..... G04B 37/00

[52] U.S. Cl. ..... 368/313; 368/309; 368/282

[58] Field of Search ..... 368/282, 281, 309, 310, 368/311, 312, 313

[56] References Cited

U.S. PATENT DOCUMENTS

| | | | |
|---|---|---|---|
| 3,861,990 | 1/1975 | Kasai et al. | 161/7 |
| 4,396,298 | 2/1983 | Ripley | 368/300 |
| 4,825,427 | 4/1989 | Wollman | 368/282 |
| 4,831,606 | 5/1989 | Aellen | 368/282 |

FOREIGN PATENT DOCUMENTS

| | | | |
|---|---|---|---|
| 0280963 | 2/1988 | European Pat. Off. . | |
| 3540737 | 5/1987 | Fed. Rep. of Germany . | |
| 976102 | 3/1951 | France . | |
| 2231042 | 12/1974 | France | 368/285 |
| 262846 | 10/1949 | Switzerland | 368/313 |
| 323054 | 7/1957 | Switzerland . | |
| 458217 | 8/1968 | Switzerland . | |

*Primary Examiner*—Bernard Roskoski

*Attorney, Agent, or Firm*—Griffin Branigan & Butler

[57] ABSTRACT

The watch case of this invention includes a caseband (2) made from sintered material and a back cover (10) secured to the caseband by means of at least two pins (12). Each pin passes through a first hole (14) provided in a first projection (16) formed in the caseband and two second holes (13, 15) provided respectively in two second projections (17, 18) formed in the back cover, said second projections being arranged respectively on either side of said first projection. Each pin being axially retained in its holes by the elastic effect provided by the seal when the caseband lies on the back cover.

5 Claims, 3 Drawing Sheets

Fig. 6
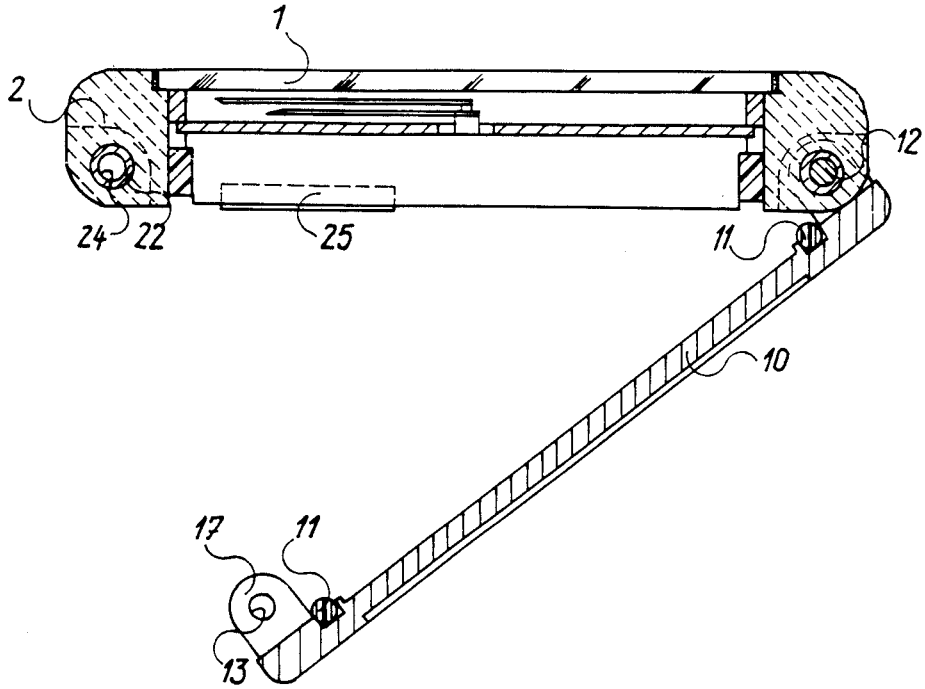
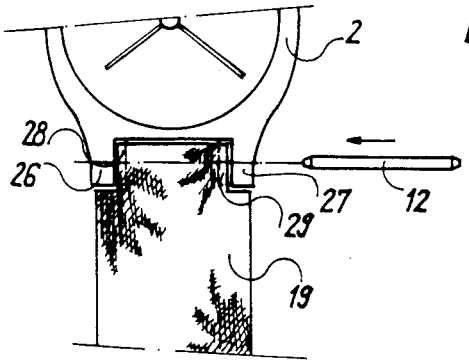
Fig. 7
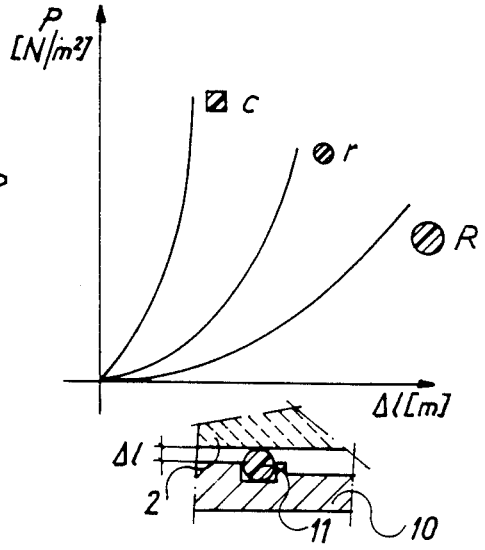
Fig. 8

WATCH CASE INCLUDING A SINTERED CASEBAND

This invention concerns a case for a wristwatch including a crystal, a caseband serving to house a movement furnished with time displaying hands, said caseband being formed from powdered materials bound together by sintering at a temperature greater than 500° C., a back cover, securing means for removably fastening the back cover to the caseband and a seal arranged between said caseband and said back cover.

BACKGROUND OF THE INVENTION

A watch case which corresponds to the general definition given above has been described in patent document EP-A-No. 0 264 875. The case is formed preferably from a ceramic material as far as the caseband is concerned, and of steel in respect of the back cover. The back cover is secured to the caseband by means of four screw fastening points. To this end the caseband is provided with holes into which plugs are driven. Each plug is then pierced and internally threaded in taking as reference the inner bore of the caseband. This technique is here employed since it is unthinkable to fasten screws directly into the ceramic. It will be however readily appreciated that such arrangement is troublesome since it requires extra pieces, namely plugs which furthermore, when driven into the holes in the caseband, run a certain risk of bursting the ceramic. The operation of piercing the plugs also requires care, thus additional manufacturing time and greater costs.

To overcome these difficulties, the watch which is sold under the registered trademark "OMEGA ART" provides as a caseband the combination of a ceramic ring and a steel circle glued to the interior of the ring. The back cover is then fastened to the caseband by means of screws directly screwed into the steel circle. This solution avoids the plugs employed in the above cited patent document, but requires manufacture of a circle and the gluing of such circle to the interior of the ceramic ring which likewise is burdensome.

The patent document CH-A-No. 458 217 describes a watch case in which the back cover is hooked to the caseband on one hand by means of studs engaging in seatings provided in a first pair of lugs borne by the caseband and on the other hand by means of two pins which at the same time pass through the back cover and a second pair of lugs. Here the pins do not in any manner serve at the same time to attach the bracelet strands to the case.

SUMMARY OF THE INVENTION

In order to overcome the cited disadvantages, this invention provides utilization of a solid caseband obtained by means of powders bound by sintering at greater than 500° C., i.e. a caseband made for instance of ceramic or of metallic carbide, without there resulting therefrom the cited difficulties inherent in the known system of fastening the cover to the caseband. In order to accomplish this, the invention is characterized in that the fastening means for the back cover to the caseband include at least two pins arranged on either side of the case and parallel to the back cover, each of said pins being accommodated in holes arranged in alignment and provided at the same time in said caseband and said back cover, each of said pins serving conjointly for attaching a strand of bracelet, as included in the watch, to the case.

The invention will be better understood in the light of the description which follows in taking into consideration by way of example only the attached drawings.

BRIEF DESCRIPTION OF THE DRAWINGS

FIG. 6 is a complete cross-section of the watch case according to the variant of FIG. 4 illustrating the manner in which the watch battery may be changed;

FIG. 7 is a partial plan view of the watch case of the invention according to a second embodiment thereof;

FIG. 8 is a diagram showing the pressure exerted on the seal as a function of the deformation of the seal and for different forms of seals.

DESCRIPTION OF THE PREFERRED EMBODIMENT

Figure 1:
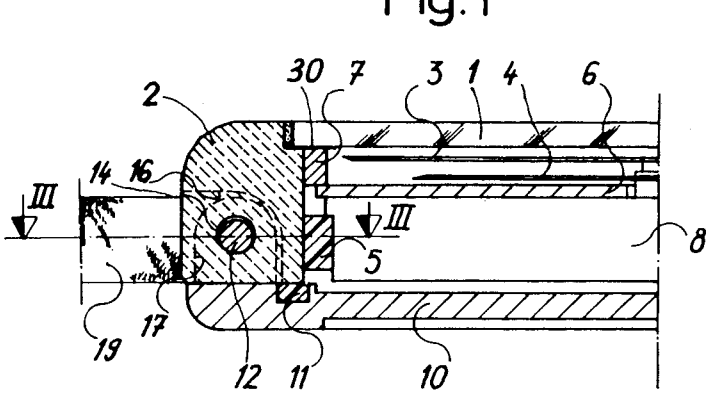
FIG. 1 is a partial cross-section at 6 o'clock of the watch case according to the invention and according to a first embodiment thereof.

FIG. 1 exhibits a first embodiment of the invention. The cross-section given shows that the case includes a crystal 1 and a caseband 2 serving to house a movement 8 provided with hands 3 and 4 displaying the time of day. In a known manner, the movement is centered in its housing by means of a casing ring 5 and its dial 6 is maintained at a distance from the crystal by means of a flange 7. The crystal 1 is glued or soldered onto the caseband. Metallization 30 may hide from view the flange and the top of the caseband.

In all the embodiments or variants presented here, the caseband 2 is obtained by means of powders bound together by sintering at greater than 500° C. It may thus for instance be formed of ceramic or of a metallic carbide obtained by sintering. The minimum temperature of 500° C. indicates that the invention does not concern the employment of plastic materials, for instance, for which other solutions may be practiced.

The case includes further a back cover 10 and a seal 11 located between the caseband and the back cover. The back cover is removably attached to the caseband by an arrangement employing pins which forms the main object of this invention and which will be described in detail hereinafter.

Figure 2:
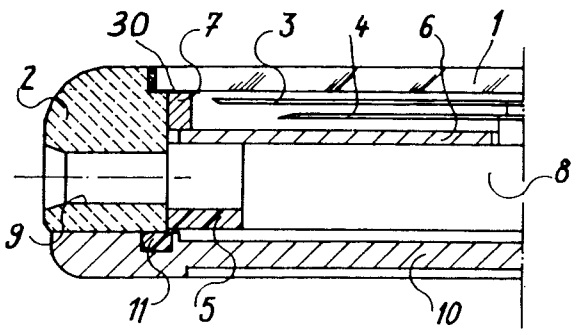
FIG. 2 is a cross-section at 3 o'clock of the same watch case.

The cross-section of FIG. 2 is taken at 3 o'clock on the watch case. Here one will recognize the same components as those described in respect of FIG. 1, such components bearing the same references. FIG. 2, in particular, shows that the caseband 2 includes a passage 9 intended to receive in a well-known manner the time setting stem (not shown).

Figure 3:
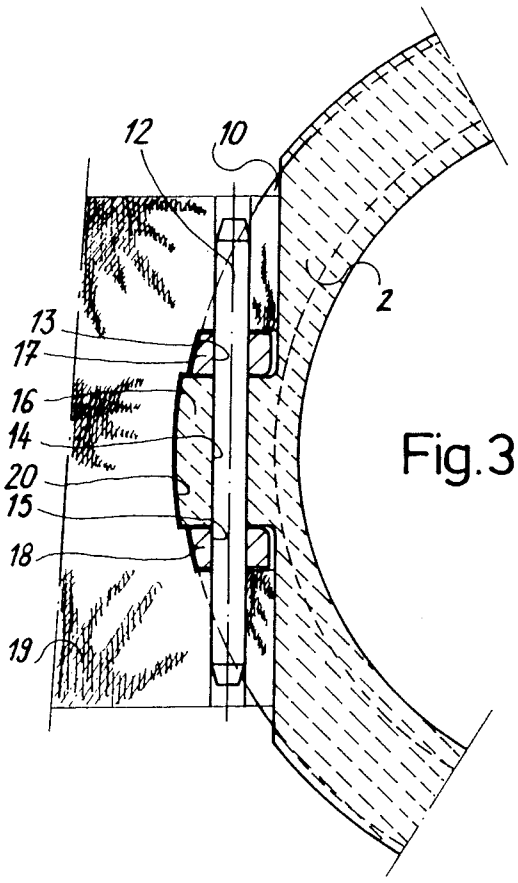
FIG. 3 is a cross-section along line III—III of FIG. 1.

FIG. 3 is a cross-section alone line III—III shown on FIG. 1. With FIG. 1, FIG. 3 shows more precisely how the back cover 10 is fastened to the caseband 2. In a completely general manner and according to the principal characteristic of the invention, the fastening means for the back cover to the caseband include at least two pins arranged on either side of the case and parallel to the back cover, a single one of these pins bearing reference 12 being shown on the drawing, taking into account that the case exhibits diametrical symmetry. Continuing in the most general sense of the invention, it will be noted that each pin is accommodated in holes 13, 14, 15 arranged in alignment and provided both in the caseband 2 and in the back cover 10.

More particularly, in line with a first embodiment of the invention shown in FIGS. 1 and 3, one of pins 10 is located at 6 o'clock and the other at 12 o'clock in the watch case. As is evident from FIG. 3, pin 10 passes through a first hole 14 provided in a first projection 16 formed in the caseband 2 and two second holes 13, 15, provided respectively in two second projections 17 and 18 formed in the back cover 10, said two second projections being respectively arranged on either side of said first projection.

In the embodiment which has just been described, FIGS. 1 and 3 show in particular that holes 13, 14 and 15 are circular and that the pin 12 is cylindrical. The arrangement is such that the pin may freely penetrate the holes which leaves one to presume a certain clearance between holes and pin (see FIG. 1). It will be understood that the pin is axially retained in its receptacle by the elastic effect provided by the seal 11 placed between the caseband 2 and the back cover 10.

As may be further seen on the drawing, one may benefit from the presence of pin 10 to attach a bracelet strand 19 to the watch. To this effect the strand includes a cutout 20 which embraces the three projections 16, 17 and 18.

Figure 4:
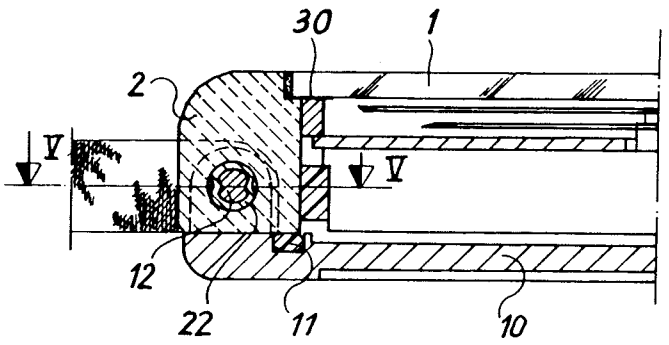
FIG. 4 is a partial cross-section at 6 o'clock of the watch case according to the invention and according to a variant of the first embodiment.
Figure 5:
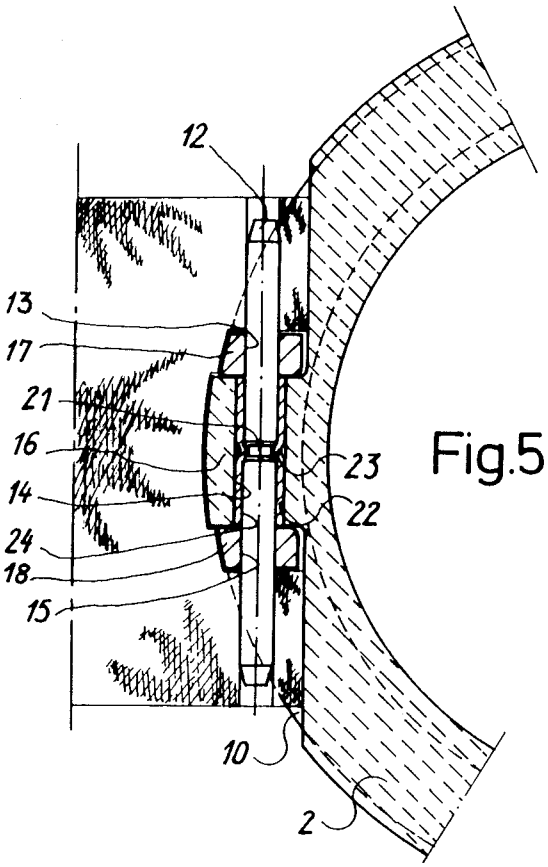
FIG. 5 is a cross-section along line V—V of FIG. 4.

A variant of the embodiment shown on FIGS. 1 and 3 is shown on FIGS. 4 and 5. In this case the pin 12 includes a groove 21 at its center. In the first hole 14 as formed in the projection 16 is housed a tube 22 provided with a constriction 23. The arrangement is such that the inner diameter 24 of the tube and the diameter of the second holes 13 and 15 are slightly greater than the diameter of the pin 12 in a manner such that the pin freely penetrates into these receptacles. Under such conditions, the pin is axially retained when the constriction 23 of tube 22 penetrates into the groove 21 of pin 22 since the ends of the tube walls will butt against the projections 17 and 18 according to a known technique set forth in the patent document CH-A-No. 235 604.

The solution presented hereinabove enables easy access to the watch battery, should the watch be thus equipped. For such access it suffices to drive a single pin out of its housing. The back cover may then swing around the remaining pin in the manner of a case cover. The battery referenced 25 may then easily be replaced. This operation is shown on FIG. 6.

In the first embodiment and its variant which have just been described above, two projections formed in the back cover embrace either side of a projection formed in the caseband. It will be understood that other arrangements may be made without departing from the principal objective of this invention. One in particular would consist of having only a single projection in the back cover such penetrating into a corresponding housing within the caseband. In this case the caseband would not include a projection strictly speaking but in addition to the cited housing a simple cutout extending along a chord of the ring exhibited by the caseband.

A second embodiment of the invention is sketched on FIG. 7. Here the caseband 2 shows at 6 o'clock two projections 26 and 27 and the back cover two projections 28 and 29, hidden by a cutout of the bracelet strand 19. The pin 12 serves as a fastening means of the back cover to the caseband in the same manner as that set forth hereinabove.

The caseband of the watch case according to the invention is formed of hard material such as ceramic or hard metal obtained by sintering powders. This material is chosen above all for its resistance to scratches and also for its attractive appearance. It is however known that such material is difficult to machine to such an extent that it is necessary to reduce to a minimum the retouch operations. In view of the present invention, these operations are no longer necessary, at least insofar as they concern the manner of attaching the back cover under the caseband. It is sufficient in effect to dimension the hole 14 which receives pin 12 in a manner such that its internal diameter remains always greater than the diameter of the pin, whatever be the dimensional modifications undergone by the material during the sintering operation (shrinking, etc.). There results therefrom a more or less substantial clearance between the pin and its receptacle and thus a more or less perfect application of the back cover to the caseband, the variable clearance leading inevitably to a variable space between back cover and caseband. A watch employing such a material is relatively expensive. One may thus normally expect in acquiring such a watch that it is sealed properly. Such sealing is brought about as has been mentioned hereinabove by means of a seal 11 arranged between back cover and caseband. In the special case of this invention, however, and in view of the more or less substantial space which may occur between back cover and caseband, it is necessary to take care to choose a seal assuring watertightness whatever be this gap.

FIG. 8 is a diagram showing the pressure p (in N/m2) exerted on the seal as a function of its deformation $\Delta 1$ (in meters) for three forms of seal: squared (c), round of small diameter (r) and round of large diameter (R). The diagram evidences that a seal having a square cross-section (c) exhibits a very limited deformation $\Delta 1$ and rapidly attains considerable pressure. On the contrary, a round section seal of large diameter (R) exhibits a very extensive deformation $\Delta 1$ and may assure sufficient pressure, even if the space between the back cover and the caseband varies within wide limits. Typically, there will be chosen a seal the diameter of which will be greater than or equal to 0.8 mm. The round section seal of small diameter (r) represents an intermediate situation. The diagram of FIG. 8 shows thus that in the watch case according to the invention, there is an advantage in choosing a seal having a round section of large diameter, although at the same time it may be mentioned that an almost identical result may be obtained by employing two round section seals of small diameter which are superposed on one another.

What we claim is:

1. A wristwatch case including a crystal, a caseband serving to house a movement equipped with time displaying hands, said caseband being formed from powdered materials bound together by sintering at a temperature greater than 500° C., a back cover, securing means for removably fastening the back cover to the caseband and a seal exhibiting an elastic effect arranged between said caseband and said back cover, said securing means including at least two cylindrical pins placed on either side of the case and parallel to the back cover, each of said pins being accommodated in aligned circular holes provided in both said caseband and in said back cover, the diameters of said holes being large enough to permit a pin to enter them freely, each pin being axially retained in its holes by elastic effect provided by said seal when the caseband lies on the back cover, each of said pins serving conjointly for attaching a strand of bracelet to the case.

2. A wristwatch case as set forth in claim 1 wherein the securing means include two pins, one thereof being at six o'clock and the other at twelve o'clock of the watch case, each pin passing through a first hole provided in a first projection formed in the caseband and two second holes provided respectively in two second projections formed in the back cover, said two second projections being arranged respectively on either side of said first projection.

3. A wristwatch case as set forth in claim 1 wherein said seal in its uncompressed state exhibits a round cross-section the diameter of which is sufficient to absorb the clearance which may occur between said caseband and said back cover when said pins are housed in said holes.

4. A wristwatch case as set forth in claim 3 wherein the cross-section of said seal exhibits a diameter greater than or equal to 0.8 mm.

5. A wristwatch case as set forth in claim 1 wherein said seal includes two superposed gaskets, each gasket in the uncompressed state exhibiting a round cross-section in order to absorb the clearance which may occur between said caseband and said back cover when said pins are housed in said holes.

* * * * *